US005989115A

United States Patent [19]

Hodge

[11] Patent Number: 5,989,115

[45] Date of Patent: Nov. 23, 1999

[54] SHARPENING GUIDE ASSEMBLY CONFIGURED FOR WEAR RESISTANCE AND METHOD OF MANUFACTURING SAME

[76] Inventor: Donald C. Hodge, P.O. Box 710, Ketchum, Id. 83340

[21] Appl. No.: 09/025,910

[22] Filed: Feb. 19, 1998

[51] Int. Cl.[6] ..... A63C 11/06

[52] U.S. Cl. ..... 451/555; 451/523; 76/83

[58] Field of Search ..... 451/545, 558, 451/555, 523; 76/83, 82

[56] References Cited

U.S. PATENT DOCUMENTS

| | | | |
|---|---|---|---|
| 3,670,601 | 6/1972 | Weeks | 76/83 |
| 3,693,219 | 9/1972 | Falkenberg | 29/78 |
| 3,766,649 | 10/1973 | Winbauer | 30/287 |
| 4,280,378 | 7/1981 | Levine | 76/83 |
| 4,601,220 | 7/1986 | Yurick, Jr. | 76/83 |
| 4,721,020 | 1/1988 | Stumpf | 76/83 |
| 4,998,956 | 3/1991 | Sherman | 76/83 |
| 5,485,768 | 1/1996 | Vermillion | 76/83 |
| 5,499,555 | 3/1996 | Vermillion | 76/83 |
| 5,643,066 | 7/1997 | Vermillion | 451/442 |

*Primary Examiner*—Joseph J. Hail, III
*Assistant Examiner*—William Hong
*Attorney, Agent, or Firm*—Havenstock, Garrett & Roberts

[57] ABSTRACT

A sharpening guide assembly for use in sharpening ski and snowboard edges includes an angle member and at least one riser member. The angle member includes at least a first outer surface and a second outer surface, an inner edge of the first outer surface adjoining an upper edge of the second outer surface. The riser member is positioned on the first outer surface of the angle member such that a top portion of the riser member extends above the first surface of the angle member. The angle member is formed of a first material and the riser member is formed of a second material, wherein the second material has a hardness which is greater than a hardness of the first material. During a sharpening operation, a sharpening tool is supported on the riser member such that the sharpening tool such as a file member is positioned above the first outer surface of the angle member so as to avoid potential wear causing contact therewith. The greater hardness of the second material as compared to the first material reduces wear on the guide assembly.

18 Claims, 2 Drawing Sheets

SHARPENING GUIDE ASSEMBLY CONFIGURED FOR WEAR RESISTANCE AND METHOD OF MANUFACTURING SAME

FIELD OF THE INVENTION

This invention relates generally to ski and snowboard edge sharpening tools and more particularly, to a sharpening guide assembly for use in association with an edge sharpening tool such as a file member to sharpen ski and snowboard edges, wherein the guide assembly is configured for improved wear resistance and extended useful life.

BACKGROUND OF THE INVENTION

Properly sharpened snow ski edges and snowboard edges are necessary to achieve desired performance in terms of edge holding and turning capabilities. In the field of ski and snowboard edge sharpening a variety of types of tools exist for sharpening the edges of skis and snowboards. For example, Stumpf U.S. Pat. No. 4,721,020, Vermillion U.S. Pat. No. 5,485,768, and Vermillion U.S. Pat. No. 5,499,555 disclose various embodiments of sharpening guides in the form of angle members used in association with sharpening tools such as file members. Problems associated with such ski and snowboard sharpening guides include both wear problems and manufacturing problems.

With respect to wear problems, the angle members constructed in accordance with the above-identified patents include an integral surface or surfaces upon which the sharpening tools rest. In practice the sharpening tools tend to result in wear of the integral surface or surfaces such that the sharpening angle provided by the guides varies over time. Such wear is unacceptable because in many applications it is necessary to sharpen the edge of a ski or snowboard to within less than one half of one degree of a certain angle. Typically the sharpening angle or desired edge angle varies between about 80 degrees and about 90 degrees. Further, the surface of the angle member upon which the ski or snowboard rests during sharpening can also wear. With respect to manufacturing problems, angle members constructed in accordance with the above patents must go through a relatively large amount of machining which results in increased manufacturing costs, and/or angle members having differently oriented outer surfaces must be produced in order to achieve different sharpening angles.

Accordingly, one object of the present invention is to provide a sharpening guide assembly for skis and snowboards having improved wear properties.

A further object of the present invention is to provide a sharpening guide assembly for skis and snowboards having reduced manufacturing costs.

SUMMARY OF THE INVENTION

In one aspect of the present invention a sharpening guide assembly for skis and snowboards includes an angle member and at least one riser member. The angle member includes at least a first outer surface and a second outer surface, an inner edge of the first outer surface adjoining an upper edge of the second outer surface. The riser member is positioned on the first outer surface of the angle member and includes a top portion extending above the first surface of the angle member. The angle member may be formed of a first material and the riser member formed of a second material, wherein the second material has a hardness which is greater than a hardness of the first material. During a sharpening operation, a sharpening tool such as a file member is supported on the riser member such that the sharpening tool is positioned above the first outer surface of the angle member so as to avoid potential wear causing contact. A sole member positioned on the second outer surface of the angle member and formed of a material which is harder than the first material may also be provided. Both the riser member material and the sole member material may be the same and are preferably a ceramic having a hardness which is greater than the hardness of the sharpening tool utilized.

In another aspect of the present invention a sharpening guide assembly for skis and snowboards includes an angle member, a first riser member, and a second riser member. The angle member includes at least a first outer surface and a second outer surface, an inner edge of the first outer surface adjoining an upper edge of the second outer surface. The first outer surface of the angle member includes first and second recesses formed therein, each of the first and second recesses including a bottom surface which is recessed relative to the first outer surface and having at least one sidewall which defines a perimeter of the recess. The first riser member includes a bottom surface and a top surface, the bottom surface positioned within the first recess of the angle member and the top surface positioned above the first outer surface of the angle member. The second riser member includes a bottom surface and a top surface, the bottom surface positioned within the second recess of the angle member and the top surface positioned above the first outer surface of the angle member. A sharpening tool such as a file member may be supported between the first and second riser members such that the sharpening tool is positioned above the first outer surface of the angle member so as to avoid potential wear causing contact therewith. Advantageously, the bottom surface of each recess may be machined to a desired angle which establishes the sharpening degree of the sharpening tool relative to the ski or snowboard edge.

The sharpening guide assemblies in accordance with the present invention provide increased wear resistance and are easily manufactured to desired sharpening angle specifications. In particular, standard extruded right angle aluminum may be used for the angle member. Although the aluminum is softer than the typical sharpening tool used in the ski and snowboard sharpening industry, the riser members and the sole member which are preferably formed of ceramic protect the angle member from wear. This protection also allows the angle member to be formed of other materials such as plastics. The riser members and the sole member are preferably secured to the angle member by an adhesive such as epoxy or a double faced pressure sensitive adhesive tape.

BRIEF DESCRIPTION OF THE DRAWINGS

For a better understanding of the present invention reference may be made to the accompanying drawings in which.

DETAILED DESCRIPTION OF THE DRAWINGS

Figure 1:
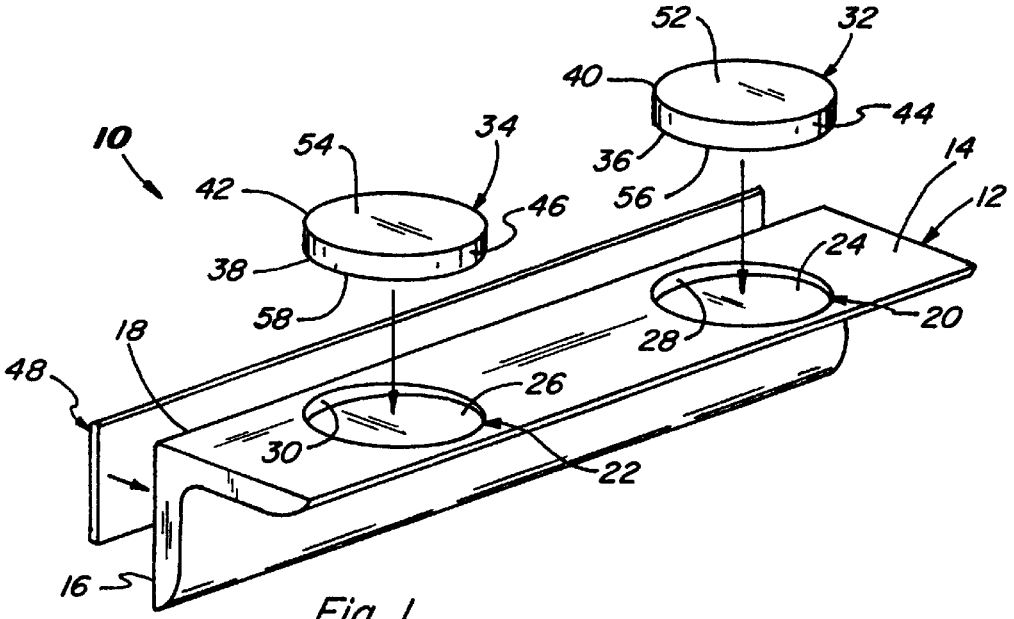
FIG. 1 is an exploded perspective view of a sharpening guide assembly of the present invention including recesses, riser members, and a sole member.

Referring now to the drawings, an exploded perspective view of a sharpening guide assembly 10 is shown including an angle member 12 having a first outer surface 14 and a second outer surface 16, the two surfaces being adjoined at a corner 18 which defines an inner edge of surface 14 and an upper edge of surface 16. Angle member 12 is preferably formed from a length of standard extruded right angle aluminum. However, it is recognized that angle member 12 could be formed of some other material such as plastic or some other metal. Although it is preferred for ease of manufacturing that standardly available right angle stock be used, it is further recognized that the surface 14 and surface 16 could be oriented to form an angle other than ninety degrees. As used herein the terminology "angle member" refers generally to any member which includes two outer, angularly adjoining surfaces, and is not limited to L-shaped members.

Angle member 12 includes a first recess 20 and a second recess 22 formed therein. Each recess 20, 22 includes a respective bottom surface 24, 26 which is recessed relative to surface 14 and a respective sidewall 28, 30 which defines a perimeter of the recess. A first riser member 32 is sized and shaped to be fitted within recess 20 and a second riser member 34 is sized and shaped to be fitted within recess 22. Each riser member 32, 34 includes a respective bottom portion 36, 38 which is positioned within respective recess 20, 22 and a respective top portion 40, 42 which extends above surface 14. Riser members 32, 34 are preferably formed of a hard ceramic, such as aluminum oxide for example, which is resistant to the type of wear which can be caused by ski sharpening tools such as files. However, it is recognized that riser members 32, 34 could be formed of some other material having a hardness greater than the hardness of angle member 12, such as a hardened steel for example. Regardless of the material utilized, each riser member 32, 34 may be secured within a respective recesses 20, 22 through use of an adhesive such as a high strength, fast drying epoxy. It is preferred that each riser member 32, 34 include an outer surface 44, 46 which is sized and shaped similar to sidewall 28, 30 of its respective recess 20, 22 to increase the holding strength provided by the adhesive utilized. In this regard, and in terms of ease of manufacture, it is preferred that each sidewall 28, 30 define a cylindrical perimeter and that each riser member outer surface 44, 46 be cylindrical in shape. However, it is likewise recognized that recesses 20, 22, and likewise riser members 32, 34, could take on other shapes, including, but not limited to ellipses, triangles, rectangles, or even some other non-conventional shape. A sole member 48 is attached to surface 16 for preventing wear of such surface. In this regard, it is preferred that sole member 48 be formed of a hard ceramic material although some other hard material could be utilized. Sole member 48 may take the form of a sheet or plate of ceramic material which is secured to surface 16 by an adhesive material such as a fast drying epoxy or a double-sided pressure sensitive adhesive tape. Although use of sole member 48 is preferred, sole member 48 could be eliminated and surface 16 could be hard anodized to reduce wear.

Figure 2:
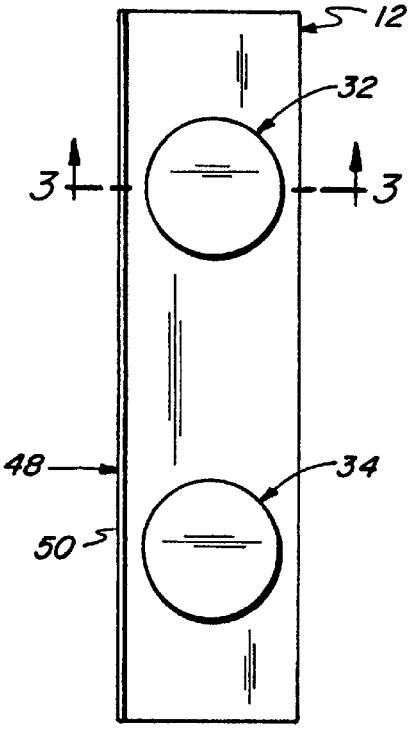
FIG. 2 is a top view of the guide assembly of FIG. 1 as assembled.
Figure 3A:
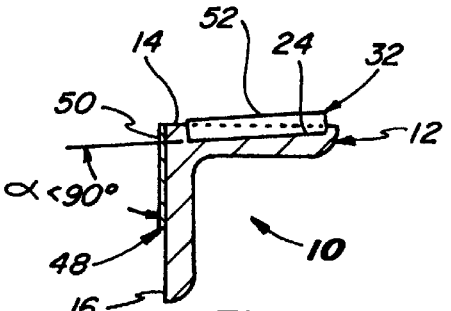
FIG. 3A is a cross-sectional view along line 3—3 of FIG. 2 illustrating one angled relationship between the bottom surfaces of the recesses and the sole member outer surface or second outer surface of the angle member.
Figure 3B:
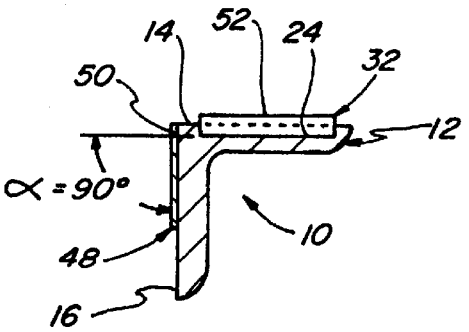
FIG. 3B is a cross-sectional view along line 3—3 of FIG. 2 illustrating another angled relationship between the bottom surfaces of the recesses and the sole member outer surface or second outer surface of the angle member.

Advantageously, guide assembly 10 not only provides reduced wear to angle member 12 but also facilitates ease of manufacturing to provide different sharpening angles as best seen from FIGS. 2, 3A, and 3B. FIG. 2 depicts a top view of guide assembly 10 as assembled, including riser members 32, 34, and sole member 48, while FIGS. 3A and 3B depict representative cross-sections along line 3—3 of FIG. 2. The bottom surface 24, 26 of each recess can be machined to define a plane which is angled relative to outer surface 50 of sole member 48, which surface 50 also defines a plane. If the upper surface 52, 54 of each riser member is parallel to the lower surface 56, 58 thereof as is preferred, and if the lower surface 56, 58 of each riser member is parallel with the bottom surface 24, 26 of each recess 20, 22 when secured therein as is preferred, then the angle $\alpha$ at the intersection of the lower surface 24, 26 plane and the sole member outer surface 50 plane establishes the cutting angle of a flat sharpening tool relative to an edge of a ski or snowboard. FIG. 3A shows bottom surface 26 of recess 22 forming an angle $\alpha$ which is less than ninety degrees and FIG. 3B shows bottom surface 26 forming an angle $\alpha$ which is ninety degrees. Thus, in accordance with the present invention a standard angle member may be used to achieve a variety of sharpening angles $\alpha$ with minimal required machining or removal of material from such angle member 12. Further, even if riser members 32, 34 are configured such that upper surfaces 52, 54 are not parallel to respective lower surfaces 56, 58, the plane defined by bottom surfaces 24, 26 of recesses 20, 22 can be appropriately angled in a predetermined manner to take into account such non-parallel variation in order to achieve a desired sharpening angle.

In this regard, manufacture of guide assembly 10 utilizing angle member 12 is relatively simple. An angle member 12 of a desired length of about four (4) to six (6) inches can be placed in an end mill and tilted to a desired angle. Material is then removed from first and second regions of first surface 14 of angle member 12 such that recesses 20, 22 are formed. The desired tilt angle of angle member 12 within the end mill is selected to result in the bottom surfaces 24, 26 of the formed recesses 20, 22 being at a predetermined angle relative to second outer surface 16 of angle member 12. Riser members 32, 34 may then be positioned within respective recesses 20, 22 and sole member 48 may be secured to outer surface 16. If riser members 32, 34 are the same size then recesses 20, 22 should be formed such that respective bottom surfaces 24, 26 thereof are substantially co-planar. It is recognized that in real world situations it may be difficult to form two different surfaces such that they are exactly co-planar and thus the terminology "substantially co-planar" is intended to cover such circumstances. Similarly, the terminology "substantially parallel" as used with respect to defined planes is likewise intended to include real world situations in which two planes may not be exactly parallel.

Figure 4:
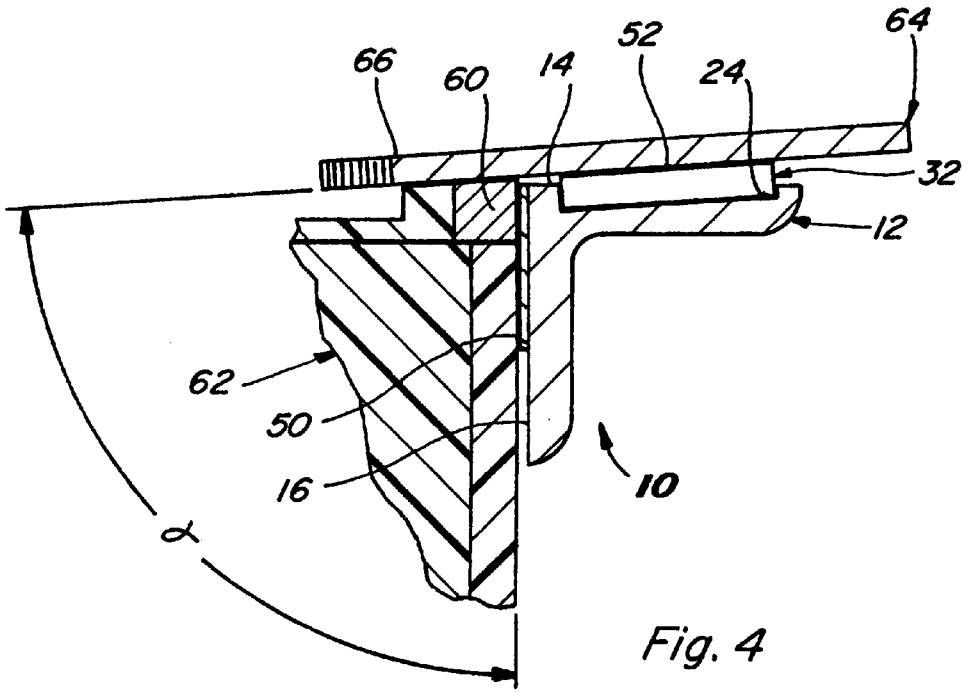
FIG. 4 is an enlarged cross-sectional view of the sharpening guide assembly as used in association with a ski and a sharpening tool.

With regard to advantages in use of guide assembly 10 reference is made to FIG. 4 which shows a cross-sectional view of guide assembly 10 when used for sharpening an edge 60 of a ski 62. Ski 62 is used by way of example only, it being recognized that guide assembly 10 is likewise suitable for use in sharpening snowboards. As shown, a sharpening tool 64 is supported on riser members 32, 34 such that a portion 66 of such tool 64 extends beyond the plane defined by sole member 48 outer surface 50. Sole member outer surface 50 is placed against ski running surface 68 such that tool 64 engages ski edge 62. By running guide assembly 10 and tool 64 along ski edge 62 such edge 62 may sharpened to the desired angle. Importantly, tool 64 is held away from angle member outer surface 14 to avoid potential wear causing contact therewith. Accordingly, recesses 20, 22 should be established at a depth which results in upper surfaces 52, 54 of riser members 32, 34 being at a height above outer surface 14 which is sufficient to prevent contact between a sharpening tool and such surface 14. Similarly, running surface 68 is held away from angle member outer surface 16 to avoid potential wear causing contact therewith. Thus, the useful life of guide assembly 10 is extended as compared to existing guides. A typical sharpening tool 64 may be a high carbon steel file member having a Rockwell C ($R_C$) hardness of about sixty-three (63). Thus, in the preferred embodiment riser members 32 and 34 and sole member 48 are formed from a ceramic such as aluminum oxide which has an $R_C$ hardness of greater than sixty-three (63) and preferably on the order of about eighty (80) so that such riser members are highly resistant to wear due to contact with the softer tool 64. Ceramic is also a preferred material because of the uniformly flat surfaces achievable with such material. However, it is likewise recognized that other suitable materials having a hardness greater than the hardness of the sharpening tool could be used. Although use of a file member has been shown and described herein it is recognized that other types of ski and snowboard sharpening tools are used in the industry and it is likewise recognized that the present guide assembly could be used in conjunction with such sharpening tools.

Figure 5:
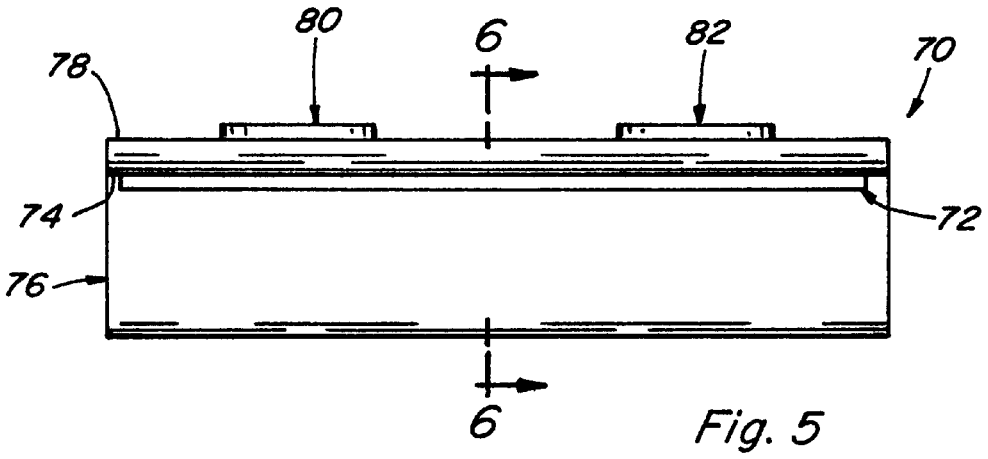
FIG. 5 is a side view of an embodiment of the present guide assembly including a finger grip.
Figure 6:
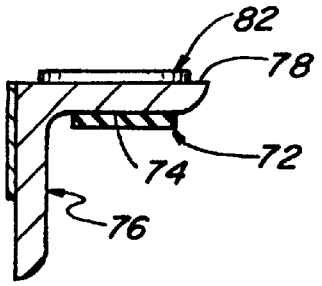
FIG. 6 is a cross-sectional view along line 6—6 of FIG. 5.

Advantageously, guide assemblies constructed in accordance with the present invention may also be provided with a suitable finger grip or pad as shown in FIGS. 5 and 6. In particular, FIG. 5 shows a side view of a guide assembly 70 including a finger pad 72 located on inner surface 74 of angle member 76, which inner surface 74 is positioned in opposed relationship to outer surface 78 having riser members 80 and 82 extending thereabove. FIG. 6 shows a cross-sectional view along line 6—6 of FIG. 5. Such finger pad 72 is preferably formed of a relatively soft material which provides some comfort when held. By way of example only, finger pad 72 could be formed of a suitable elongated strip of ethyl vinyl acetate material, closed-cell sponge material, or a soft nitryle rubber material, and such materials could be suitably affixed to surface 74 by an adhesive such as fast drying epoxy or double-sided pressure sensitive adhesive tape. It is also recognized that the shape and size of finger pad 72 could be varied without departing from the scope of the present invention.

From the preceding description of the illustrated embodiments, it is evident that the objects of the invention are attained. In particular, a sharpening guide assembly having increased wear resistance is attained by using a riser members and/or a sole member which is harder than the angle member, and which is preferably harder than the sharpening tool used. Further, the present guide assembly reduces the amount of machining required on the angle member to achieve a desired sharpening angle.

Although the invention has been described and illustrated in detail, it is to be clearly understood that the same is intended by way of illustration and example only and is not to be taken by way of limitation. For example, although the guide assembly of the present invention has been shown and described as including two riser members, it is recognized and anticipated that a guide assembly in accordance with the present invention could be constructed having a single suitably positioned and shaped riser member, or three or more riser members. Similarly, the positioning of the riser members on the angle member surface could be varied to accommodate different sharpening tools. Further, although the riser members are shown and described as positioned in recesses, it is recognized that such riser members could also be positioned and secured directly on the angle member outer surface so as to avoid potential wear resistant contact between a sharpening tool and such surface. In such cases the top surface of such riser members could be angled relative to the bottom surface thereof to establish a desired sharpening angle of the sharpening tool relative to an edge being sharpened. Accordingly, the spirit and scope of the invention are to be limited only by the terms of the appended claims.

What is claimed is:

1. A sharpening guide assembly for use in sharpening skis and snowboards, comprising:

an angle member including at least a first outer surface and a second outer surface, an inner edge of the first outer surface adjoining an upper edge of the second outer surface, the angle member formed from a first material;

at least one riser member positioned in a first recess formed on the first outer surface of the angle member and a having a top portion extending above the first outer surface of the angle member, the riser member formed from a second material;

wherein the second material has a hardness which is greater than a hardness of the first material; and wherein the first recess is angled such that the sharpening tool is angled to a predetermined angle, wherein, during a sharpening operation, a sharpening tool is supported on the riser member such that the sharpening tool is positioned above the first outer surface of the angle member so as to avoid potential wear causing contact therewith.

2. The sharpening guide assembly, as set forth in claim 1, wherein the first outer surface of the angle member includes at least one recess formed therein, the recess including a bottom surface which is recessed relative to the first outer surface, and the at least one riser member including a bottom portion positioned within the recess.

3. The sharpening guide assembly, as set forth in claim 2, further comprising:

a sole member positioned on the second outer surface of the angle member, the sole member formed from a third material, the third material being harder than the first material; and wherein, during a sharpening operation, a member being sharpened is positioned against the sole member such that the member is held away from the second outer surface so as to avoid potential wear causing contact therewith.

4. The sharpening guide assembly, as set forth in claim 3, wherein the second material and the third material are ceramic.

5. The sharpening guide assembly, as set forth in claim 3, wherein the bottom surface of the recess region defines a first plane, the bottom portion of the riser member includes a lower surface which defines a second plane, the top portion of the riser member includes an upper surface which defines a third plane, the sole member includes an outer surface which defines a fourth plane, the second plane and the third plane being substantially parallel planes, and an angle defined by the intersection of the first plane and the fourth plane establishes the cutting angle of the sharpening tool relative to an edge being sharpened.

6. The sharpening guide assembly, as set forth in claim 1, wherein the assembly includes both a first riser member and a second riser member, each riser member being positioned on the first outer surface of the angle member.

7. The sharpening guide assembly, as set forth in claim 1, wherein the second material is ceramic.

8. The sharpening guide assembly, as set forth in claim 1, wherein the second material has an $R_C$ hardness of greater than sixty-three.

9. The sharpening guide assembly, as set forth in claim 1, wherein the angle member is substantially L-shaped, the guide assembly further comprising:

a finger pad positioned on a first inner surface of the angle member, the first inner surface being positioned in opposed relation to the first outer surface.

10. A sharpening guide assembly for use in sharpening skis and snowboards, comprising;

an angle member including at least a first outer surface and a second outer surface, an inner edge of the first outer surface adjoining an upper edge of the second outer surface, the first outer surface including first and second recesses formed therein, each of the first and second recesses including a bottom surface which is recessed relative to the first outer surface and having at least one sidewall which defines a perimeter of the recess;

a first riser member including a bottom surface and a top surface, the bottom surface positioned within the first recess of the angle member and the top surface positioned above the first outer surface of the angle member;

a second riser member including a bottom surface and a top surface, the bottom surface positioned within the second recess of the angle member and the top surface positioned above the first outer surface of the angle member; and wherein the first and second recesses are angled such that the sharpening tool is angled to a predetermined angle, wherein, during a sharpening operation, a sharpening tool may be supported between the first and second riser members such that the sharpening tool is positioned above the first outer surface of the angle member so as to avoid potential wear causing contact therewith.

11. The sharpening guide assembly, as set forth in claim 10, wherein the second outer surface of the angle member defines a first plane, the bottom surface of the first recess is substantially coplanar with the bottom surface of the second recess to define a second plane, and the lower surface of both the first riser member and the second riser member is substantially parallel with the respective upper surface thereof, such that an angle defined by the intersection of the first plane and the second plane establishes the cutting angle of the sharpening tool relative to an edge being sharpened.

12. The sharpening guide assembly, as set forth in claim 10, further comprising:

a sole member positioned on the second outer surface of the angle member such that a member positioned thereagainst for sharpening is held away from the second outer surface so as to avoid potential wear causing contact therewith.

13. The sharpening guide assembly, as set forth in claim 12, wherein an outer surface of the sole member defines a first plane, the bottom surface of the first recess is substantially coplanar with the bottom surface of the second recess to define a second plane, and the lower surface of both the first riser member and the second riser member is substantially parallel with the respective upper surface thereof, such that an angle defined by the intersection of the first plane and the second plane establishes the cutting angle of the sharpening tool relative to an edge being sharpened.

14. The sharpening guide assembly, as set forth in claim 10, wherein both the bottom portion of the first riser member and the bottom portion of the second riser member are shaped and sized to abut the sidewall of its respective recess.

15. The sharpening guide assembly, as set forth in claim 14, wherein the respective sidewall of each of the first and second recesses forms a cylindrical shape and each of the riser members is cylindrical in shape.

16. The sharpening guide assembly, as set forth in claim 10, wherein both the first riser member and the second riser member are formed from a first material and the angle member is formed from a second material, the first material having a hardness which is greater than a hardness of the second material.

17. The sharpening guide assembly, as set forth in claim 16, wherein both the first and second riser members are formed from a ceramic material.

18. The sharpening guide assembly, as set forth in claim 10, wherein the angle member is substantially L-shaped, the guide assembly further comprising:

a finger pad attached to a first inner surface of the angle member, the first inner surface being positioned in opposed relation to the first outer surface.

* * * * *